US007682034B2

(12) United States Patent
Asvadi et al.

(10) Patent No.: US 7,682,034 B2
(45) Date of Patent: Mar. 23, 2010

(54) LIGHT-SOURCE WITH FABRIC DIFFUSING LAYER

(75) Inventors: Sima Asvadi, Eindhoven (NL); Martijn Krans, Eindhoven (NL); Michel Paul Barbara Van Bruggen, Eindhoven (NL); Johannes Theodorus Adriaan Wilderbeek, Eindhoven (NL); Jacob Marinus Jan Den Toonder, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 292 days.

(21) Appl. No.: 11/915,447

(22) PCT Filed: May 23, 2006

(86) PCT No.: PCT/IB2006/051652

§ 371 (c)(1),
(2), (4) Date: Nov. 26, 2007

(87) PCT Pub. No.: WO2006/129246

PCT Pub. Date: Dec. 7, 2006

(65) Prior Publication Data

US 2008/0205035 A1 Aug. 28, 2008

(30) Foreign Application Priority Data

May 31, 2005 (EP) ..... 05104677
Aug. 31, 2005 (EP) ..... 05107974

(51) Int. Cl.
*F21V 21/08* (2006.01)
*F21V 5/00* (2006.01)

(52) U.S. Cl. ..... 362/103; 362/311.01; 362/311.02; 362/357

(58) Field of Classification Search ..... 362/103, 362/249.02, 355, 357, 311.01–311.03, 105, 362/106, 107, 800; 359/599; 313/116; 257/98; 2/160

See application file for complete search history.

(56) References Cited

U.S. PATENT DOCUMENTS

| | | | | |
|---|---|---|---|---|
| 6,072,619 | A | 6/2000 | Kiryuschev et al. | |
| 2006/0207139 | A1 * | 9/2006 | Deflin et al. | 40/544 |
| 2008/0218369 | A1 * | 9/2008 | Krans et al. | 340/691.1 |

FOREIGN PATENT DOCUMENTS

| | | | |
|---|---|---|---|
| GB | 2396252 | A | 6/2004 |
| JP | 2003223121 | A | 8/2003 |
| WO | 199927298 | A | 6/1999 |
| WO | 2004100111 | A2 | 11/2004 |
| WO | 2004100113 | A2 | 11/2004 |

OTHER PUBLICATIONS

"Electronic Textiles Charge Ahead", Science, vol. 301, Aug. 15, 2003, www.sciencemag.org.
Paula Gould; "Textiles Gain Intelligence", Materialstoday, Oct. 2003.

* cited by examiner

*Primary Examiner*—John A Ward

(57) ABSTRACT

A light-source comprising at least one lighting unit (101) being arranged on a substrate (102) and a diffusing element (103) being arranged to receive and diffuse light emitted by said at least one lighting unit (101) is provided. The diffusing element (103) comprises a layer of non-woven fabric having a lower density at a side facing the lighting unit and a higher density at a side opposite to the lighting unit to obtain good diffusing properties.

27 Claims, 2 Drawing Sheets

LIGHT-SOURCE WITH FABRIC DIFFUSING LAYER

The present invention relates to a light-source comprising at least one lighting unit being arranged on a substrate and a diffusing element being arranged to receive and diffuse light emitted by said at least one lighting unit. The present invention also relates to a diffusing layer for arrangement on a light-source.

Large area light emitting textiles would open up a wide range of new interior and apparel applications, ranging from illumination to atmosphere creation to messaging.

LEDs are a promising light source candidate for textile integration. However, LEDs are small point sources of light. Multiple LEDs distributed over the surface of a fabric will not allow the entire fabric to emit light, but just the small fraction of the fabric covered with the source.

For many light emitting textile applications it is desired to have a more uniform out-coupling of light from the fabric surface.

One problem is how to distribute the light emitted from each LED over the entire area between neighboring LEDs. Another problem is that LED light sources mounted on top of a fabric limit the soft look and feel that is normally associated with a textile.

WO 2004/100111 to France Telecom describes flexible displays having light emitting diodes arranged on a textile support of woven threads, where the circuitry is included in the woven threads. These light emitting diodes are point sources, and to produce a substantially continuous light display, WO 2004/100111 describes the use of a diffuser with several possible materials to diffuse the light from adjacent light emitting diodes to form a homogenous light field on the surface of the diffuser.

However, this document does not disclose how to make use of the diffuser material in order to obtain good diffusing effect.

It is an object of the present invention to overcome this problem and to provide a light-source having a diffuser material with good diffusing properties.

Thus, in a first aspect the present invention relates to a light-source comprising at least one lighting unit being arranged on a substrate and a diffusing element being arranged to receive and diffuse light emitted by said at least one lighting unit, wherein the diffusing element comprises at least one layer of non-woven fabric.

In typical lighting applications, there is typically a distance (air gap) between the lighting units and the diffusive material, which sometimes also hides the light source from a viewer. The air gap is required to enable the cone of light to expand before it is scattered by the diffusive material. The air gap has to remain essentially constant for homogeneous scattering effect.

Non-woven fabric is produced from fibrous web bonded by mechanical entanglement of the fibers or by use of resins, thermal fusion and formation of chemical complexes. The fibers in the web can be arranged in a random or oriented fashion. Thus, a non-woven material in essence is a mixture of air and fibers. To ensure a homogenous diffusion and expansion of the light cone in a uniform manner a random assembly of fibers in the non-woven fabric is preferred. Therefore, it contains the two essential elements for diffusion: air and randomness of the fibrous material. However, an oriented non-woven fabric could be used to create a special effect if required.

In embodiments of the present invention, the density of the non-woven fabric may be lower at a face of the diffusing element facing a lighting unit compared to the density at a face of the diffusing element opposite to said lighting unit. For example, the diffusing element may comprise a first layer of non-woven fabric arranged adjacent to the lighting units and a second layer of non-woven fabric arranged on said first layer, where the density of said second layer being higher the density of said first layer.

The portion of the diffusing element being located close to the lighting units has a low density, and thus provides a spacing between the lighting units and the more dense portion of the diffusing element. In this spacing, the cone of light emitted by the lighting units may expand, before encountering the more dense portion of the diffusing element, where the major part of the light diffusion occurs. The low-density portion also helps keeping the space between the lighting units and the denser portion acceptably constant, even if the light-source is bended, etc.

The denser portion of the diffusing element is to diffuse the light and hence provide homogeneity to the light-containing surface.

The light source may further comprise at least one layer of whitish fabric on top of the diffusing element. The fabric can for example be woven or knitted to give the device a traditional fabric feel. Preferably, the cover layer is white or whitish to avoid color filtering.

The display device can further comprise at least one layer of colored open structure fabric on top of the diffuser element. The colored open structure fabric layer(s) can for instance be placed on top of the whitish fabric cover layer(s), or on top of the diffusing element if there is no whitish fabric cover layer (s). The colored open structure fabric cover layer(s) can for example be a fishnet or lace type fabric. The colored open structure fabric cover layer(s) acts as a contrast enhancing anti-reflective coating on the display device, and it allows the display to have any color in the off state, without acting as a color filter in the on-state (due to the open structure).

In embodiments of the present invention comprising at least two lighting units, the diffusing element may be arranged to diffuse light emitted by two adjacent lighting units to produce a substantially continuous light display on a face of the diffusing element opposite to said lighting units, i.e. facing a viewer of the light-source.

The lighting units in a light-source of the present invention may comprise at least one light emitting diode.

Light emitting diodes are attractive as lighting units as they typically have high efficiency and low power consumption.

A lighting unit may comprise one or more light emitting diodes of the same color or may comprise two or more light emitting diodes of different colors, in order to provide a lighting unit that may be color variable. If each of the light-emitting diodes in the lighting unit is independently addressable, different colors may be provided by varying the intensity of light from the individual light emitting diodes.

In embodiments of the present invention, the light-source may comprise at least a first and an adjacent second lighting unit, and the diffusing element may comprise a first domain, diffusing light emitted by said first lighting unit, and a second domain, diffusing light emitted by said second lighting unit, wherein said first and second domains are at least partially optically separated by a barrier means.

The barrier means separating said first and second diffusing element domains may for example comprise a seam, joining said diffusing element to said substrate.

Such barriers will prevent color mixing at the borders between the light fields from adjacent lighting units of different colors. Furthermore, such barriers will create frames, "pixels", to enhance the color and/or sharpness of the light pattern produced on the surface of the light-source.

In embodiments of the present invention, the lighting units and the substrate, on which the lighting units are arranged, are encapsulated in a translucent encapsulation. Such an encapsulation may for example provide mechanical wear-resistance to a light-source of the present invention. The encapsulation may be elastomeric. The encapsulation may comprise light-scattering elements.

In a second aspect, the present invention also relates to a light-diffusing element for arrangement on a light source, which light-source comprises at least one lighting unit, said diffusing element comprising at least one layer of non-woven fabric.

In embodiments of this second aspect of the invention, the density of the non-woven fabric may be lower at a face of the diffusing element adapted to face a lighting unit of the light source, compared to the density at a face of the diffusing element opposite to said lighting unit. For example the diffusing element may comprise at least a first layer of non-woven fabric adapted to face the lighting unit and a second layer of non-woven fabric arranged on said first layer, the density of said second layer being higher the density of said first layer.

In a third aspect, the present invention also relates to different textile products comprising an integrated light-source and a diffusing element.

This and other aspects of the present invention will now be described in more detail, with reference to the appended drawings showing a currently preferred embodiment of the invention.

Figure 1:
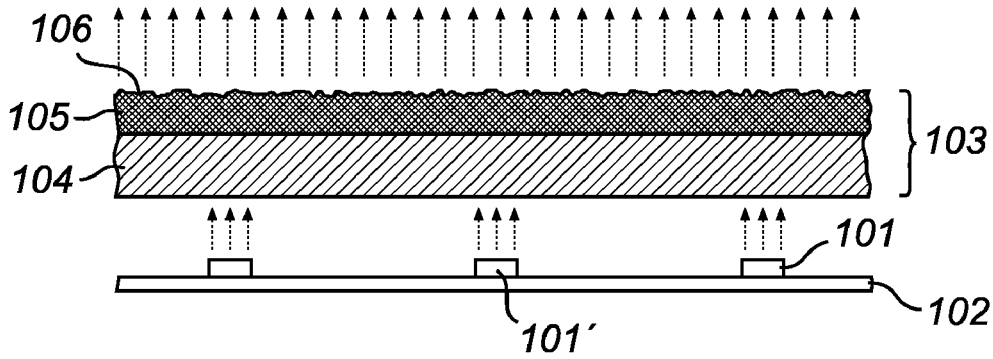
FIG. 1 illustrates a cross sectional view of an exemplary embodiment of a light-source according to the present invention.

A first embodiment of a light-source according to the present invention is illustrated in FIG. 1, and comprises an array of lighting units 101, each comprising a light emitting diode, arranged on a substrate 102, and a light diffuser 103 being arranged on the array.

The light diffuser 103 comprises a first layer 104 of a low-density non-woven fabric in facing the lighting units 101, and a second layer 105 of a non-woven fabric whose density is higher than that for the first layer 104.

As used herein, the term "light emitting diode" or "LEDs" relates to light emitting diodes capable of emitting light in the wavelength range of from infrared to ultra violet light. The term also relates to all different kinds of LEDs, including organic based LEDs, polymeric based LEDs and inorganic based LEDs, as well as laser diodes.

Lighting units of the present invention advantageously comprises one or more light emitting diodes. However, other lighting units, for example based on incandescent bulbs, light emitting chemical reactions, etc, may also be used.

As used herein, the term "substrate" refers to a structure on or in which the light emitting diodes are arranged. The term refers to both rigid, essentially non-flexible, substrates and flexible substrate. Several non-flexible, "rigid", and flexible substrate materials are known to those skilled in the art, and the substrate material is not essential to this invention.

Light diffusers of the present invention are especially advantageous for diffusing light emitted by lighting units arranged on "flexible" substrates, as the diffuser is made of flexible materials. However, light diffusers of the present invention are also suitable for use on "rigid" substrate based light sources.

As used herein, the term "non-woven fabric" refers to a fabric essentially comprising of separate fibers being bonded together for example by use of resins or mechanical entanglement, i.e. contrary to woven fabric, where the fibers typically are held together by weaving of the yarn and also twisting of the fibers in the yarn.

Fiber material suitable for use in non-woven fabrics according to this invention include, but are not limited to, natural textile fibers, such as cotton and wool fibers, regenerated fibers, such as viscose, and synthetic fibers such as polyester, polyamide (nylon) and polyacrylic fibers.

As used herein, the term "density" when it relates to the density of a non-woven fabric, refers to the mean density of fibers in the fabric, a reciprocal relationship to the average mesh size in the fabric, the average distance between two adjacent fibers.

The light diffuser 103 is arranged to receive light emitted by the lighting units 101 and to diffuse the light, such that the light from two adjacent lighting units produces a substantially continuous light display on the face 106 of the light diffuser 103 opposite to the lighting units, herein also referred to as the viewing surface of the diffuser.

Thus, the diffusion of light accomplished by the light diffuser should be at least in the range of the distance between adjacent lighting units in the light-source.

The first layer 104 of non-woven fabric having a lower density is arranged to cover the light emitting diode and to provide for a distance between the lighting units and the second layer 105 of non-woven fabric having a higher density.

To a certain extent, the first layer 104 diffuses light, but it also provides spacing between the lighting units and the second layer 105. In this spacing, the light cone expands before encountering the second layer. The second layer 105, being of higher density than the first layer 104, diffuses the light so that a homogenously enlightened surface 106 of the light diffuser is obtained.

For a certain density and thickness of the second layer 105, the thickness and/or the density of the first layer 104 may be varied according to the distance between adjacent lighting units 101 and the brightness of the light emitted by the lighting units 101 in order to produce a homogenously enlightened surface 106 on the light.

One non-limiting example of a diffuser of non-woven material, suitable for a light-source, where the distance between adjacent lighting units are in the range of 20 mm, is a ~20 mm thick double layered polyester non-woven fabric. The innermost non-woven layer was 15 mm thick having a fiber density of $6.5\times10^3$ g/m$^3$, mainly serving as spacing for the outermost non-woven layer. This outermost non-woven layer was 6 mm thick having a fiber density $14\times10^3$ g/m$^3$, for diffusing the light emitted by the lighting units to an essentially homogenous enlightenment of a thin woven polyester layer covering the diffuser.

Figure 2:
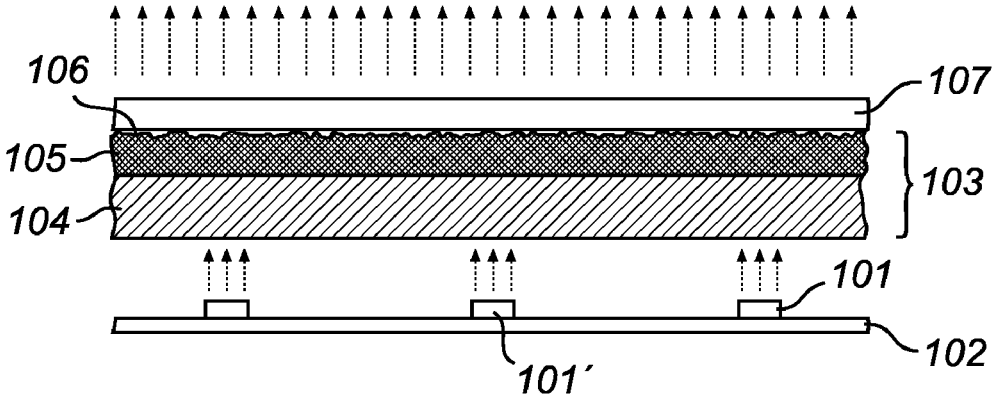
FIG. 2 illustrates a cross-sectional view of another exemplary embodiment of a light-source according to the present invention.

In FIG. 2, at least one layer of whitish fabric 107 is positioned on top of the diffuser 103. The whitish fabric can for example be woven or knitted to give the device a traditional fabric feel.

Figure 3:
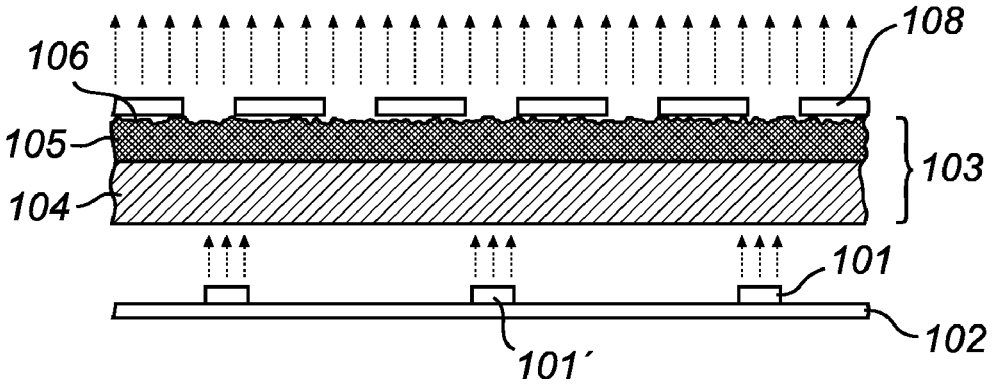
FIG. 3 illustrates a cross-sectional view of another exemplary embodiment of a light-source according to the present invention.

In an alternative embodiment, shown in FIG. 3, the light source includes at least one cover layer of colored open structure fabric 108 arranged on the diffuser element 103. The colored open structure fabric cover layer(s) 108 can for example be a fishnet or lace type fabric. The colored open structure fabric layer(s) acts as a contrast enhancing ant-reflective coating on the display device, and it allows the display to have any color in the off state, without acting as a color filter in the on-state (due to the open structure). It should be noted that in the presence of a layer(s) 107 on top of the diffuser 103, the open structure layer 108 should be arranged on top of such layer(s)

Figure 4:
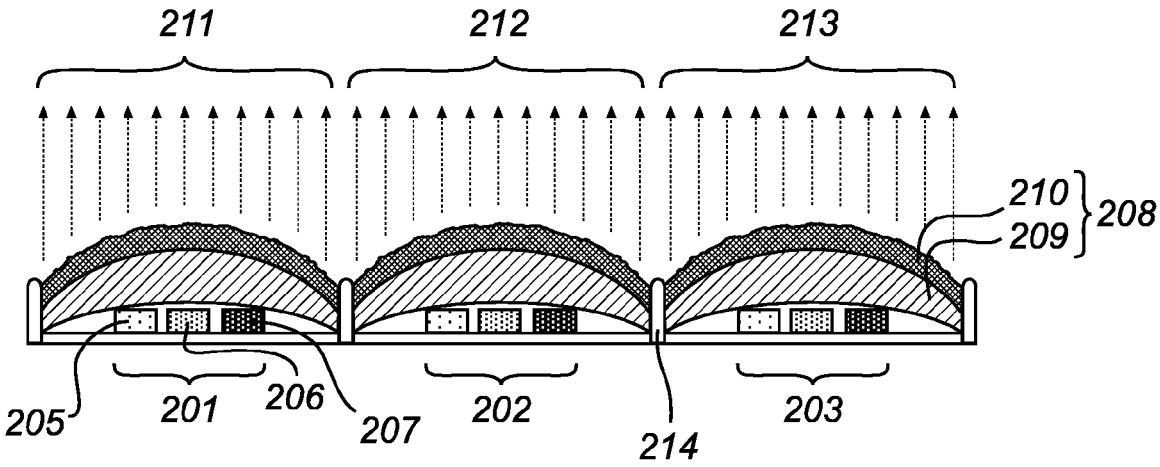
FIG. 4 illustrates a cross sectional view of yet another exemplary embodiment of a light source according to the present invention.

A second embodiment of the present invention is illustrated in FIG. 4 and comprises an array of discrete lighting units 201, 202, 203 arranged on a substrate 204, each lighting unit comprising three individually addressable light emitting diodes, a red 205, a green 206 and a blue 207.

Each lighting unit thus functions as a color variable lighting unit, a pixel, where different colors are obtained by varying the intensities of light emitted from the different colored light emitting diodes.

A light diffuser 208 comprising a first layer 209 and a second layer 210 is arranged on the array to receive and diffuse emitted by the light emitting diodes.

The light diffuser 208 is divided into several domains "pixels", 211, 212, 213, one domain of light diffuser for each lighting unit 201, 202, 203.

The domains are separated by a barrier 214 to prevent light emitted by a first lighting unit 201 to be diffused onto the surface of the light diffuser 212 covering an adjacent lighting unit 202.

The barrier 214 is obtained by joining the non-woven fabric of the light diffuser 208 and the substrate 204. This may be obtained in different manners, depending on the diffuser material and the substrate material. For example, the diffuser 208 could be joined to the substrate 204 by stitching the fabric to the substrate material, in that way compressing the diffuser material towards the substrate so that the diffuser material becomes essentially opaque at the stitches. Stitching a border around each lighting unit provides the desired barriers. Other ways of obtaining the barrier include, but are not limited to, gluing or fusing the diffuser material to the substrate in order to compress the diffuser material by bringing the surface of the diffuser opposite to the lighting units close to the substrate.

Color mixing is due to that the light cones from adjacent lighting units overlap before exiting the light source.

Barriers to prevent substantial color mixing and thus to divide the light source into a plurality of at least partially optically separated pixels may be obtained in a plurality of manners.

Barriers to prevent color mixing may be divided into two main groups:

(i) barriers preventing or reducing overlap between light cones from adjacent lighting units, and (ii) barriers allowing overlap but blocking or reducing light from overlapping regions.

As used herein, "optically separated", in the context of optically separating two adjacent domains of a diffusing element from each other, refers to that light emanating from a first lighting unit, corresponding to a first domain of a diffusing element, is prevented from being easily perceivable at the viewing side of an adjacent second domain of the diffusing element, i.e. such that substantial color mixing is prevented.

The term "substantial color mixing", as used herein, is to be taken as a color mixing which is easily perceivable by a viewer of the light source. Typically, a lighting unit emits light in an essentially Lambertian pattern, i.e. where the intensity is essentially proportional to the viewing angle. Thus, even if light mixing occurs due to light emitted at very oblique angles towards an adjacent lighting unit, the intensity of the light that giving rise to this color mixing is very low, and thus this color mixing is barely perceivable.

Examples of the first category include arranging barriers that extend from the substrate towards the viewing surface of the light-source, i.e. from the side of the diffuser adapted to face the substrate towards the viewing side of the diffuser, in order to prevent overlap by forming a non-transparent wall.

The barriers may extend essentially parallel to the normal of the substrate towards the viewing surface.

The barriers may extend non-parallel to the normal of the substrate towards the viewing surface, for example as to form a funnel-shaped space inside the barriers.

In a first exemplary embodiment of a light-source comprising barriers of type (i), a first layer of non-woven fabric is arranged on an array of lighting units to provide spacing between the lighting units and a second layer of non-woven fabric, acting as light diffuser. The first layer of non-woven material is a discontinuous layer forming discrete "islands" of non-woven material on top of each lighting unit. The sidewalls of each "island", extending between the lighting unit and the second layer of non-woven material comprises an essentially opaque surface material, thus optically isolating the islands from each other.

In a second exemplary embodiment of a light-source comprising barriers of type (i), a first layer of non-woven fabric is arranged to provide spacing between the lighting units and a second layer of non-woven fabric, acting as light diffuser. In this embodiment, the first layer is continuous, however comprising funnel-like openings through the layer such that each lighting unit is located in an opening in the layer. The funnels extend from the substrate on which the lighting units are arranged to the second non-woven layer. The sidewalls of the funnels may be provided with a reflective coating in order to enhance the efficiency of the light-source.

In an exemplary embodiment of a light-source comprising barriers of type (ii), a first layer of non-woven fabric is arranged on an array of lighting units to provide a spacing between the lighting units and a second layer of non-woven fabric, acting as light-diffuser. Depending on the thickness of the non-woven layers, the light cones from adjacent lighting units are allowed to combine in either the first or the second non-woven layer. An essentially opaque mask is arranged on the viewing surface of the light-source to cover the locations where substantial color mixing occurs, and thus light from these color-mixed areas does not exit the light-source.

Embodiments of the present invention may comprise barriers of both type (i) and type (ii).

The person skilled in the art realizes that the present invention by no means is limited to the preferred embodiments described above. On the contrary, many modifications and variations are possible within the scope of the appended claims. For example, it is not necessarily desired that the diffusing effect of the diffuser should be in the order of the distance between adjacent lighting units. In some cases, it may be desired to obtain a more inhomogeneous enlightenment of the surface of the diffuser, and thus, a lower degree of diffusion may be desired.

Further, it is not necessary that the diffuser material comprise two layers of non-woven fabric in order to obtain the desired effects. In embodiments of the present inventions, the light diffuser may comprise single layer of non-woven fabric where the fiber density exhibits a gradient, having a lower density at the surface facing the lighting units and a higher density at the surface opposite of the lighting units.

In other embodiments, only one homogenous layer of diffusing non-woven fabric is enough to provide the desired effect.

In embodiments of the present invention, the light diffuser may be of a colored material to obtain a light filtering effect in the diffusing material. Such a colored diffuser may have at least two effects: (i) enhancing a certain color provided by the lighting units, and (ii) to provide color conversion in the diffuser, for example by converting white light emitted by the lighting units, into light of a different color or color temperature.

In embodiments of the present invention, the non-woven light diffuser may be covered by an additional layer. Such layers include, but are not limited to, textiles to provide a textile appearance of the light-source, and plastics.

In embodiments of the present invention, the lighting units and the substrate on which the lighting units are arranged may be encapsulated in a translucent or transparent encapsulation. Typically, this encapsulation is of an elastomeric material, such as for example, but not limited to standard flexible materials as silicones, resins, gels and gel-like materials that are easily processed and applied.

An encapsulation of the lighting units and the substrate may be advantageous to provide strength and wear-resistance to the light-source. A light diffuser of non-woven material does not provide essentially any protection to the lighting units against mechanical influences, such as scratching and impacts.

An elastomeric encapsulation is desired in the case of a substrate that is "flexible", e.g. in a light-source which is adapted and suitable for being bent and/or rolled during normal operation.

In addition, the encapsulation may also provide spacing between the lighting units and the non-woven light diffuser of the present invention.

Further, the encapsulation may comprise light scattering elements, such as solid inorganic particles or air/gas-bubbles, to enhance the diffusion of light emitted by the light-source of the present invention.

Areas of application for a light-source of the present invention include, but are not limited to, devices where light production is desired and where a soft surface and/or flexible device are desired. Examples include, but are not limited to, curtains, furnishing fabrics, vehicle ceilings, bed textiles, banners, flags, carpets, cuddly toys and garments, for example safety garments.

In embodiments of the present invention, the device comprising the light source of the present invention is interactive and connected to a communication means and/or a sensor.

In one example, the light-source is comprised in an interactive pillow or toy, such as a cuddly toy, which in addition comprises a communication means, such as an Internet connection interface or a mobile phone, for example a GSM-module.

The communication means is capable of receiving data and to control the emission of light from the light source according to the received data. The received data could for instance represent an image or a text message, such as sent as an SMS-message or e-mail, to be displayed on the pillow or toy.

Such an interactive pillow or cuddly toy may also comprise pressure sensors, for detecting pressure on the pillow, which sensor is connected to the control means to allow for touch sensitivity functionality.

Another example of an interactive device comprising a light source of the present invention is a floor mat/table cloth with pressure sensors, which allows for touch display functionality, for example to enable gaming, activity exercising, measuring weight or baby development, etc.

Yet another example of an interactive device comprising a light source of the present invention is clothing, for example a glove or a jacket sleeve, with a light source connected to a digital compass. Such a glove is capable of indicating which direction the glove is pointing, for example indicating each direction with a separate color or pattern, and could in addition be connected to a GPS (global positioning system) receiver in order to guide the wearer of the clothing in a desired direction.

Yet another example of an interactive device comprising a light source of the present invention is a backpack further comprising an audio player and speakers, wherein the audio system is connected to the light source, such as to display sound related information, for example audio equalizer signals, ambient patterns or song content description.

The invention claimed is:

1. A light-source comprising at least one lighting unit (101) being arranged on a substrate (102) and a diffusing element (103) being arranged to receive and diffuse light emitted by said at least one lighting unit (101), said diffusing element (103) comprising at least one layer of non-woven fabric, characterized in that the density of the diffusing element (103) is lower at a first side of the diffusing element facing a lighting unit compared to the density at a second side of the diffusing element opposite to said lighting unit.

2. A light-source according to claim 1, wherein said diffusing element (103) comprises at least a first layer of non-woven fabric (104) and a second layer of non-woven fabric (105) arranged on said first layer, said first layer facing said substrate (102), the density of said second layer (105) being higher the density of said first layer (104).

3. A light-source according to claim 1, further comprising at least one layer of whitish fabric (107) on top of said diffusing element.

4. A light-source according to claim 1, further comprising at least one layer of colored open structure fabric (108) on top of said diffusing element (103).

5. A light-source according to claim 3, wherein said layer of colored open structure fabric (108) is arranged on top of said layer of whitish fabric (107).

6. A light-source according to claim 1, wherein said at least one lighting unit comprises at least one light emitting diode.

7. A light-source according to claim 1, comprising at least two lighting units (101, 101'), wherein said diffusing element (103) diffuses light emitted by two adjacent lighting units to produce a substantially continuous light display on a face (106) of the diffusing element opposite to said lighting units.

8. A light-source according to claim 1, comprising at least a first lighting unit (201) and an adjacent second lighting unit (202), wherein said diffusing element (208) comprises a first domain (211) to diffuse light emitted by said first lighting unit (201) and a second domain (212) to diffuse light emitted by said second lighting unit (202), and said first and second domains are at least partly optically separated by a baffler means (214).

9. A light-source according to claim 8 wherein said barrier means comprises a light-blocking mask arranged on said diffusing element.

10. A light-source according to claim 8, wherein said barrier means (214) comprises non-transparent walls extending from said first side towards said second side of said diffusing element.

11. A light source according to claim 10, wherein said barrier means (214) comprises a seam joining said diffusing element to said substrate.

12. A light-source according to claim 1, wherein said at least one lighting unit (101) and said substrate (102) is encapsulated in a translucent encapsulation.

13. A light-source according to claim 12, wherein said translucent encapsulation comprises an elastomeric material.

14. A light-source according to claim 12, wherein said translucent encapsulation comprises light-scattering elements.

15. A light-diffusing element (103) for arrangement on a lighting unit, said diffusing element comprising at least one layer of non-woven fabric, wherein the density of the diffusing element is lower at a first face of the diffusing element adapted to face a lighting unit of said light source, compared to the density at a second face of the diffusing element adapted to be opposite to said lighting unit.

16. A light-diffusing element according to claim 15, wherein said diffusing element (103) comprises at least a first layer (104) of non-woven fabric arranged to face said lighting unit and a second layer (105) of non-woven fabric arranged on said first layer, the density of said second layer being higher the density of said first layer.

17. A light-diffusing element according to claim 15, further comprising at least one layer of whitish fabric (107) on top of said diffusing element.

18. A light-diffusing element according to claim 15, further comprising at least one layer of colored open structure fabric (108) on top of said diffusing element (103).

19. A light-diffusing element according to claim 17, wherein said layer of colored open structure fabric (108) is arranged on top of said layer of whitish fabric (107).

20. A light-diffusing element according to claim 15, wherein said diffusing element (208) comprises at least a first domain (211) and a second domain (212), at least partly optically separated by a barrier means (214).

21. A light-diffusing element according to claim 20, wherein said barrier means comprises a light-blocking mask arranged on said diffusing element.

22. A light-diffusing element according to claim 20, wherein said barrier means (214) comprises non-transparent walls extending from said first face towards said second face of said diffusing element.

23. A textile product, comprising a light-source according to claim 1.

24. A textile product according to claim 23, comprising a communication means adapted to receive data and a means to control the emission of light from said light source according to said received data.

25. A textile product according to claim 23, comprising a sensor means adapted to detect a sensible condition and to control the emission of light from said light source according to said detected condition.

26. A textile product according to claim 25, wherein said sensor means is selected from the group consisting of temperature sensors, light detectors, compasses, positioning systems, pressure sensors and microphones.

27. A textile product according to claim 23, being selected from the group consisting of pillows, furnishing fabric, garments, gloves, banners, flags, carpets, curtains, vehicle ceilings, bed textiles, cuddly toys and back packs.

* * * * *